United States Patent [19]

Bernardis et al.

[11] Patent Number: 4,629,343

[45] Date of Patent: Dec. 16, 1986

[54] MATRIX PRINTING DEVICE

[75] Inventors: Francesco Bernardis, Chiaverano; Carlo Motta, Borgofranco, both of Italy

[73] Assignee: Ing. C. Olivetti & C., S.p.A., Ivrea, Italy

[21] Appl. No.: 661,212

[22] Filed: Oct. 15, 1984

[30] Foreign Application Priority Data

Oct. 14, 1983 [IT] Italy ..... 68064 A/83

[51] Int. Cl.[4] ..... B41J 3/04

[52] U.S. Cl. ..... 400/124; 101/93.05

[58] Field of Search ..... 400/124, 124 IW, 124 TC, 400/124 WD, 124 VI; 101/93.05

[56] References Cited

U.S. PATENT DOCUMENTS

| | | | |
|---|---|---|---|
| 4,225,250 | 9/1980 | Wagner et al. | 400/124 |
| 4,244,658 | 1/1981 | Mori | 101/93 OS X |
| 4,377,348 | 3/1983 | Isobe et al. | 400/124 |
| 4,407,591 | 10/1983 | Adamoli et al. | 400/124 |
| 4,423,969 | 1/1984 | Kobryn | 400/124 |
| 4,453,840 | 6/1984 | Hodne | 400/124 |
| 4,511,269 | 4/1985 | Takahashi et al. | 400/124 |
| 4,539,905 | 9/1985 | Zenner | 400/124 X |

FOREIGN PATENT DOCUMENTS

| | | | |
|---|---|---|---|
| 37173 | 4/1981 | Japan | 400/124 |
| 150570 | 11/1981 | Japan | 400/124 |

*Primary Examiner*—Charles Pearson

*Attorney, Agent, or Firm*—Banner, Birch, McKie & Beckett

[57] ABSTRACT

A matrix printing device includes a housing body which can effect a translational movement relative to a printing surface in use, a plurality of wires slidable in the housing body and each having one end for acting on the print surface as a result of a thrust exerted on the other end, and a plurality of oscillating operating members each of which can exert a thrust on a respective wire. Electromagnetic excitation circuits selectively oscillate each of the operating members from a rest position to a position of thrusting the respective wire. The operating members are fixed to a single resilient support element. The position of fixing of each operating member to the support element and the resilient properties of the support element determine, respectively, the path of oscillation of the operating member and the degree of resilient force which returns the member to the rest position.

8 Claims, 5 Drawing Figures

MATRIX PRINTING DEVICE

The present invention relates to wire or matrix printing devices, and is concerned particularly with a printing device comprising a housing body which, in use, can effect a translational movement relative to a printing surface, a plurality of wire elements (needles) slidable in the housing body and each having one end for acting on the printing surface as a result of a thrust exerted on its other end, a plurality of oscillating operating members, each of which can exert a thrust on a respective wire element, and electromagnetic excitation circuits for selectively oscillating each of the members from a rest position to a position of thrusting the respective wire element.

A printing device of the type specified above is described in U.S. Pat. No. 4,407,591 corresponding to Italian patent application No. 68304-A/80 assigned to the same assignee as the present application.

In this printing device of known type, a substantially annular or tubular resin mass with a flat end face incorporates the electromagnetic excitation circuits which control the oscillation of the needle operating members. These members, each of which is a blade of ferromagnetic material associated as a movable armature with one of the excitation circuits, are arranged in a generally stellate configuration in positions concentric with the flat end face of the retaining resin mass. Elastic rings (O-rings) support the operating members in a rest position, in which the radially outer end of each member is in contact (with the interposition of a layer of insulating material, for example Mylar) with the flat end face of the retaining mass, while the opposite end lies at a certain distance from the face itself.

The energization of the corrsponding electromagnetic circuit causes the return of all the operating members (armatures) towards the surface of the retaining mass. As a result of the oscillation of the operating member, the radially inner end of the member itself exerts a thrust on one end of the corresponding printing element (needle), causing the transfer of a dot onto the printing surface.

This device of known type, although allowing very satisfactory results to be obtained, gives rise to difficulties of realization and construction.

In the first place, it is necessary to provide guides for each operating member in the housing body, which can regulate the oscillation of the member itself very precisely. The housing body is normally made from molded plastic material because of the requirements of weight and cheapness of manufacture. However, this manufacturing technique does not allow the working tolerances of the guides for the operating members to be controlled precisely.

Some defects in the working of the housing body (dressing-off and the like) may then pass unobserved during assembly of the device and cause it to operate defectively, particularly with regard to the uniformity of behavior of the individual printing elements.

Further operating defects may be put down to the fact that O-rings are used to support the operating members in their rest positions. Such rings do not generally allow an identical return force towards the rest position to be applied to all the operating members.

Consequently, the operating members, although being ferromagnetic blades which are identical to each other, may have excitation-response characteristics which are different from each other.

The object of the present invention is to solve the aforementioned problems by providing a precise and reliable printing device which is simple and economical to manufacture and use.

According to the present invention, this object is achieved by virtue of a device of the type specified above, characterized in that it includes a single resilient support element to which the oscillating operating members are fixed; the position of fixing of each operating member to the support element and the resilient properties of the support element itself determining, respectively, the path of oscillation of the operating member and the degree of resilient force returning the member to its rest position.

The resilient support element normally comprises an annular band and a plurality of appendages extending radially from this band, each of these appendages constituting a support body for the fixing of a respective operating member.

The invention is applicable preferably to a printing device of the type specified above, in which the electromagnetic excitation circuits are incorporated in a substantially annular retaining mass having a flat end face, and in which the operating members, each of which is associated like a movable armature with one of the excitation circuits, are distributed in a radial or stellate configuration on the flat end face of the retaining mass.

In such an application, the device according to the invention is characterized in that:

each operating member is fixed to the resilient support element in correspondence with that face of the member opposite the retaining mass, a spacer element having a thickness slightly less than the thickness of the operating members is provided between the retaining mass and the annular band of the resilient support element, and the housing body has associated pressure means which act on the annular band of the support element to thrust the support element and the spacer element against the said end face of the retaining mass and cause, as a result of the difference in thickness between the spacer element and the operating members, the resilient deformation of the support element and the consequent orientation of the operating members into a rest position in which the end of each operating member opposite the support element is at a certain distance from the flat end face of the retaining mass and is selectively returnable towards this end face, to exert the thrust on the corresponding wire element, by the activation of the corresponding electromagnetic excitation circuit.

Preferably, the pressure means comprise a plurality of flexible arms, each of which acts on the annular band of the support element in a position angularly intermediate the fixing appendages of two adjacent operating members, whereby the resilient deformation of the support element is achieved essentially by twisting of the annular band.

In the currently preferred embodiment, the flexible arms constitute integral parts of a cover member coupled to the housing body in a position which is selectively variable in order to regulate the pressure exerted by the flexible arms on the support element.

Normally, the resilient support element is formed from stainless steel; and the operating members, which are made from ferromagnetic material, are fixed to the support element by capacitive discharge welding.

The invention will now be described, purely by way of non-limiting example, with reference to the appended drawings, in which.

Figure 1:
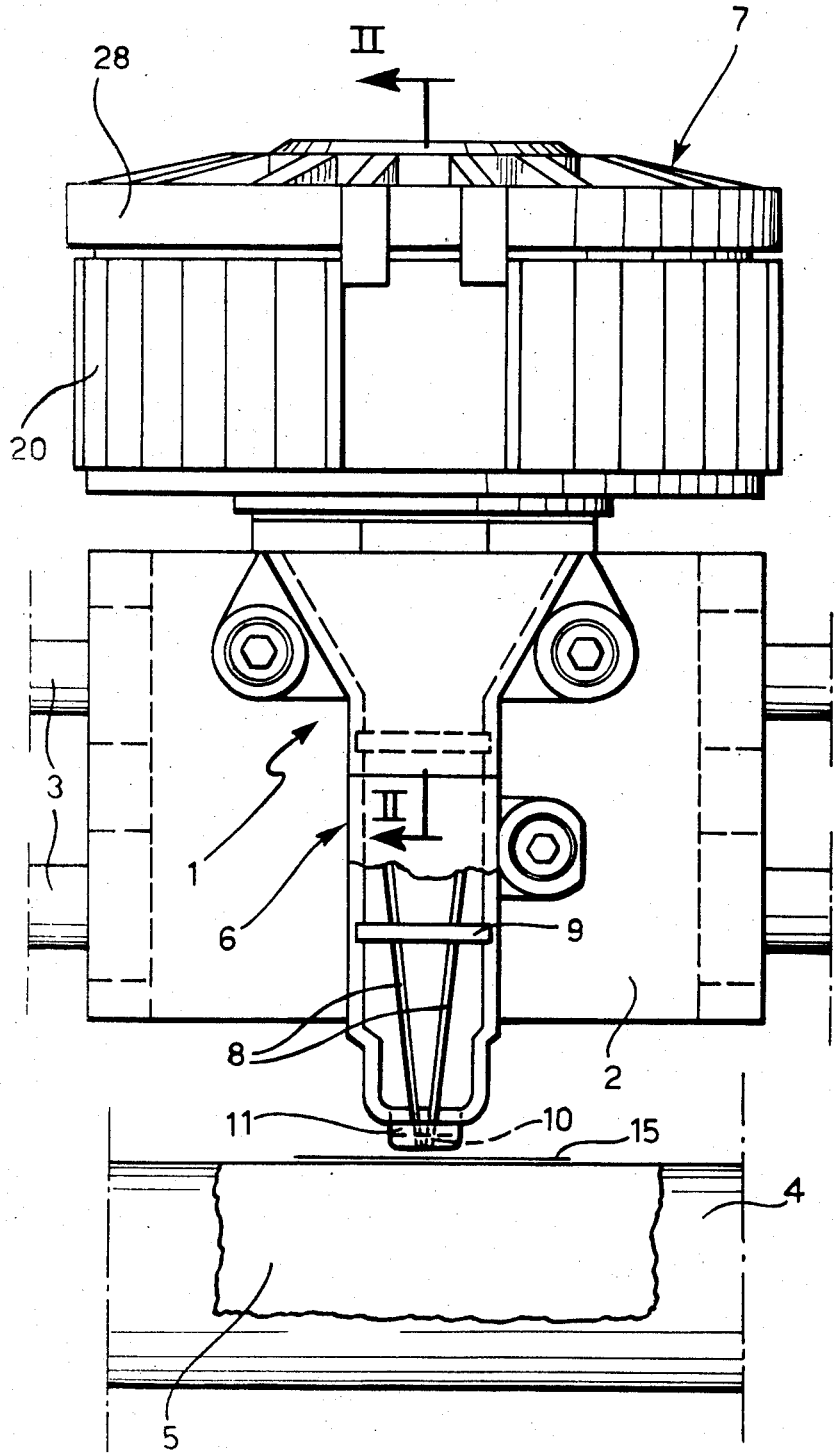
FIG. 1 is a partially cut-away plan view of a matrix printing device according to the invention.

With reference to FIG. 1, a printing device (head) is generally indicated 1 and is mounted on a carriage 2 of a printing or typing machine of generally known type, for example the serial printer described in Italian patent application No. 67869-A/80 by the same Applicants.

The carriage 2, normally of molded plastic material, is slidable on a pair of guides 3 parallel to a roller 4 on which a sheet of paper 5 constituting the printing or typing surface is disposed. In operation, according to the method currently used in the art, the carriage 2 slides on the guides 3 under the action of drive means not illustrated. As a result of the movement of the carriage 2, the printing device (head) 1 describes a straight translational path parallel to the axis of the roller 4, effecting the scanning of a line on the sheet.

The rotation of the roller 4, driven in discrete steps by further drive means not illustrated, means that the head 1 effects a complete scan of the lines on the sheet 5.

The housing of the head 1, which is also of molded plastic material, can be seen to consist essentially of a front or guide section 6 and a rear or operating section generally indicated 7.

Within the guide section 6 are mounted a plurality of axially slidable metal printing wires (needles) 8.

Figure 2:
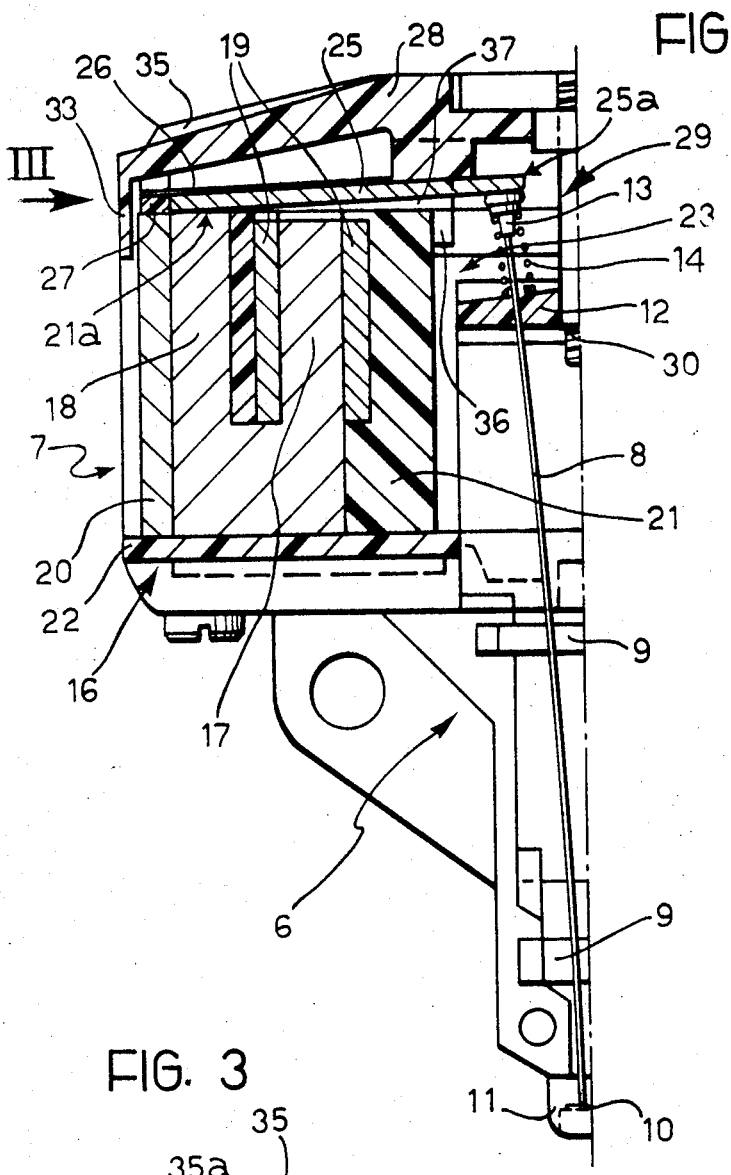
FIG. 2 is a partial section taken on the line II—II of FIG. 1, showing the internal structure of the printing device of the type illustrated in FIG. 1.

As best seen in FIG. 2, the guide section 6 is constituted essentially by a prismatic or tubular casing with internal transverse partitions (plates) 9 having through-holes which guide the wires 8 and allow only their translation in a longitudinal direction. The ends of the wires facing the roller 4, called the printing ends 10, converge into an end plate located at the front end of the guide section 6.

In the embodiment illustrated in the appended drawings, there are thirteen wires or needles 8; the printing ends 10 are arranged in two parallel columns comprising, respectively, seven and six elements spaced apart by a uniform distance in each column with one column staggered by half this distance with respect to the other column.

At their ends opposite the printing ends 10, the wires 8 slide in apertures provided in a further partition or plate 12 located centrally within the operating section 7 of the printing device, which has an overall cylindrical or tubular shape. The apertures in the partition 12 are arranged substantially in a circle.

At their rear ends, that is to say, at the ends opposite the printing ends, each wire 8 has a profiled head 13. Between each head 13 and the partition 12 which guides the rear ends of the wires 8, there is a helical spring 14 which, at rest, holds the corresponding wire 8 in a withdrawn, inoperative position.

The assembled arrangement of the wires 8 is such that, when a thrust is exerted on the head 13 in the manner which will be better described below, the printing end 10 of the wire is projected from the front plate 11 of the guide section 6. The printing end 10 then hits an inked ribbon 15 which is wound between two reels (not illustrated) fixed to the carriage 2, and has a middle section interposed between the printing device 1 and the printing surface 5.

The effect of the ballistic action exerted on the ribbon 15 by the printing end 10 of the wire is such as to cause the transfer of a dot of ink onto the printing surface 5.

The operation of energization of the various wires 8 in a sequence co-ordinated with the sliding movement of the carriage of the guides 3 and the advance of the roller 4, and in dependence on the distribution of the printing ends 10 (printing matrix), allows the transfer of alphanumeric characters and other graphic symbols onto the printing surface 2. The criteria which regulate the operation of the wires 8 in dependence on the various printing formats and the movement of the printing device 1 relative to the printing surface 5 are well known to experts in the art and will not therefore be described in detail.

In order to operate the wires 8, that is, to achieve the transfer of ink dots from the ribbon 15 to the printing surface 5 as a result of the impact of the printing ends 10 on the ribbon 15 itself, a plurality of actuating electromagnets 16 is provided in the operating section 7, each of which is constituted by a core of ferromagnetic material comprising a triangular-sectioned arm 17 and a rectangular-sectioned arm 18 connected together in a generally U-shape, and by an excitation coil 19. In order to make the shape described above at a limited cost, the cores of the electromagnets 16 are preferably manufactured by sintering ferromagnetic powders. The excitation electromagnets 16 are assembled in an array within a tube 20 of non-magnetic material with a high thermal conductivity, for example sintered aluminum, and are incorporated in a single resin block 21 which adheres to the inside of the tube 20.

The tube 20 is shaped so as to provide within it equiangularly-spaced seats in which the arms of the cores of the electromagnets 16 are captive. The tube 20 also has external radial fins to improve the dissipation of heat developed by the electromagnets 16 during operation of the head 1.

The resin block 21 also incorporates a printed circuit 22 with separate supply tracks for each of the coils 19. On the opposite face of the resin block 21, the circuit 22 has terminals for the supply tracks, which allow the connection of each coil 19 to an external control circuit (not illustrated).

The arrangement described is such that the electromagnets 16 are in fact incorporated in a retaining mass constituted essentially by the resin block 21 and the tube 20 surrounding it.

This retaining mass has an overall annular shape and has a central through-hole 23 in which the guide section 6 of the casing is engaged. The retaining mass 21 and the guide section 6 of the casing have complementary shapes which allow precise axial positioning of the coupled parts relative to each other.

More particularly, the retaining mass 21 incorporating the electromagnets 16 has, at its end opposite the guide section 6 of the casing, that is at the "rear" side of the printing device, a flat end face 21*a* which is approximately coplanar with the plane in which the heads 13 associated with the rear ends of the wires 8 are located.

Figure 3:
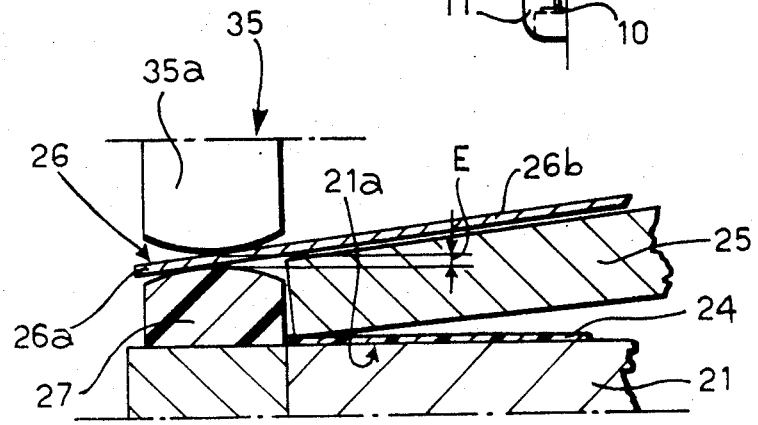
FIG. 3 is a view taken on the arrow III of FIG. 2 showing in detail, and on an enlarged scale, the relative disposition of several of the elements illustrated in FIG. 2, and FIGS. 4 and 5 show in detail the structure of several members illustrated in FIGS. 2 and 3.

A plurality of pivoted operating members 25 constituted by thin shaped sheets of ferromagnetic material, such as ferro-cobalt, are applied to the end face 21*a* of the retaining mass 21 with the interposition of a thin disc 24 of plastic material such as Mylar (which is clearly visible in FIG. 3).

Each operating element 25 is associated, like a movable armature, with a corresponding control electromagnet 16.

The disc 24, which is interposed between the operating members 25 and the end face 21*a* of the retaining mass 21, has the purpose of defining precisely the gap between the cores 17, 18 of the electromagnets 16 and the movable armatures 25 associated therewith.

The operating members 25 are thus arranged in a generally stellate or radial configuration which reproduces the star shaped or ray disposition of the electromagnet 16 and of the heads 13 of the wires 8. More particularly, each operating element 25 cooperates at its radially inner end 25*a* with the head 13 of a corresponding wire 8, and its middle part overlies the cores 17, 18 and the excitation coil 19 of the corresponding electromagnet 16.

When the electromagnets 16 are de-energized, the operating members 25 associated therewith are located in a rest position in which the ends 25*a* cooperating with the heads 13 of the wires 8 are raised from the end face 21*a* of the retaining mass 21, while the opposite ends rest on the periphery of the face 21*a*.

When an energizing pulse is applied to one of the electromagnets 16, the operating element associated therewith is returned violently against the end face 21*a*. The element 25 in fact constitutes the movable armature of an electromagnetic circuit which, when the coil 19 is energized, disposes itself in the configuration of minimum reluctance, in which the gap separating the movable armature 25 from the end face 21 is defined by the thickness of the disc 24.

As a result of the oscillation of the operating element 25 consequent on its return towards the marginal face 21*a*, the radially inner end 25*a* of the element 25 itself acts on the head 13 of the corresponding wire 8 which is made to slide within the guide apertures in the partitions 9, 12 against the return force exerted by the spring 13. The electrical energizing pulse applied to the electromagnet is then converted into an impulsive mechanical force applied to the wire 8. As a result of this force, the printing end 10 of the wire is projected against the ribbon 15 causing, as described above, the transfer of an ink dot to the print surface 5. A generally annular resilient element 26 acts as a resilient support element for the operating members 25.

Figure 4:
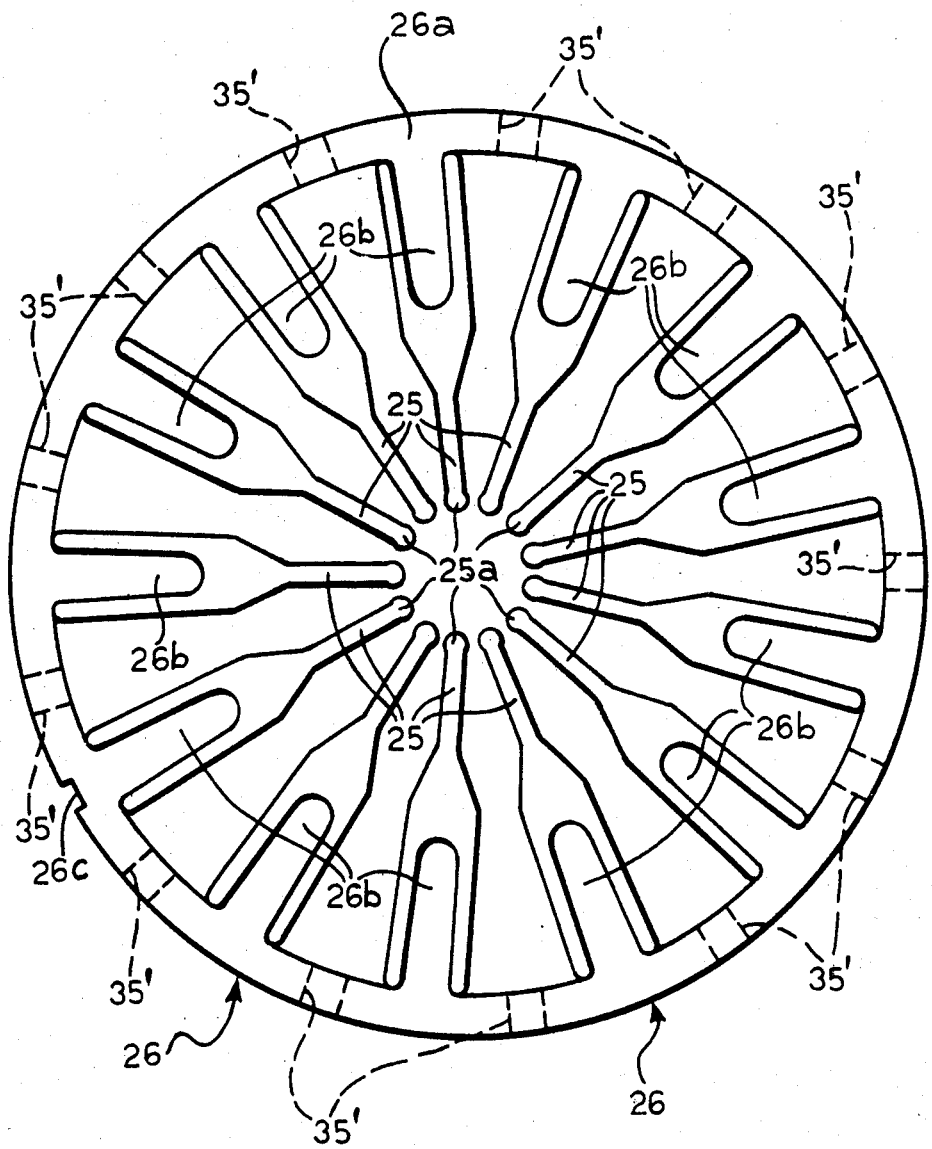

The element 26, illustrated in detail in FIG. 4, is manufactured by blanking from a sheet of resilient material, such as stainless steel, and is constituted essentially by an outer annular band 26*a* from which extend radial appendages 26*b* equal in number to the operating members 25.

As illustrated in FIG. 4, each appendage 26*b* converges radially inwardly of the annular band 26*a* and acts as a support body for a respective operating element 25.

Each of these members is firmly fixed to the respective support appendage 26*b* by capacitive discharge welding.

The operating members 25 and the support element 26 thus constitutes a self-contained unit which can be assembled separately before installation in the device 1, so as to assure very precise relative positioning of the parts.

In fact, the assembled position of each operating element 25 on the corresponding appendage 26*b* defines uniquely the position taken up by the element 25 itself when installed in the printer device.

This result cannot be achieved easily with the solutions of the prior art, in which separate guide and positioning means are provided for each operating element 25. The unit constituted by the operating members 25 and the support element 26 is applied to the end face 21*a* of the retaining mass 21 with the interposition of the separator disc 24 and an annular spacer element 27 normally made from plastic material such as Delrin. In order to achieve the correct angular positioning of the operating members, at least one notch 26*c* is provided in the band 26*a* for cooperating witha corresponding projection provided, for example, on the rim of the tube 20.

The geometry of the spacer element 27 corresponds substantially to the geometry of the annular band 26*a* of the support element 26 overlying it. The end face of the element 27 intended to be applied against the retaining mass 21 is flat; however the opposite face is radially curved, as shown schematically in FIG. 3.

The maximum thickness of the spacer element 27 is selected so as to be slightly less than the thickness of the operating members 25.

According to a currently preferred embodiment, the operating members 25 have a length of about 20 mm and a thickness of about 1.2 mm. The maximum thickness or maximum height of the spacer element 27 is selected to be about 1 mm.

The difference in level between the upper outer edge of the operating members 25 and the line of the crest of the spacer element 27, which is schematically indicated E in FIG. 3, is thus about 0.2 mm. The thickness of the Mylar disc 24, which is about 30 um, thus contributes negligibly to the value of this difference in level. For this reason, the dimensional relationship between the thickness of the operating members 25 and the thickness or height of the spacer element 27 has been summarized in the present specification and in the following claims by the description that "the spacer element 27 has a thickness slightly less than the thickness of the operating members 25".

A cover of molded plastic material, generally indicated 28, is applied as a closure element to the rear face of the operating section 7 of the device 1.

In its position of assembly on the device 1, the cover 28, which is generally cup-shaped, covers the support element 26 and the operating members 25 applied to the end face 21*a* of the retaining mass 21.

The cover 28 is fixed to the body of the device 1 by means of a screw 29 which is engaged in a corresponding threaded hole 30 provided centrally in the partition or plate 12 which guides the rear ends of the wires 8.

Figure 5:
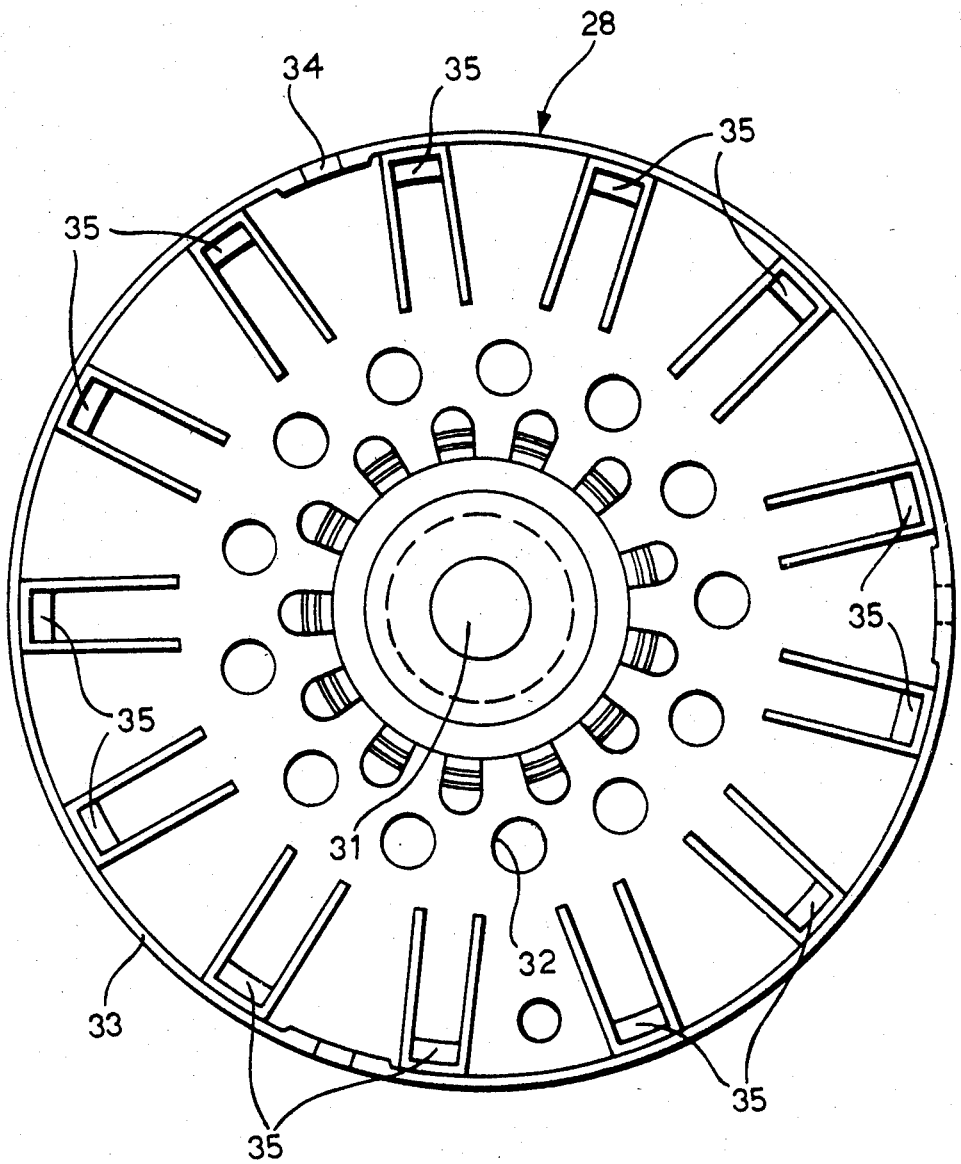

FIG. 5 illustrates solely the cover 28 removed from the printing device and seen from its concave side. As shown in the drawing, in addition to a hole 31 for the fixing screw 29, the body of the cover 28 is provided with a plurality of apertures 32 which allow the ventilation of the electromagnetic operating circuits 16.

The cover 28 includes a peripheral edge 33 intended to act as the outer edge of the end face 21*a* of the retaining ring 21 connecting it to the containing tube 20. The peripheral edge 33 is normally provided with a projection 34 which allows the correct angular positioning of the cover 28 on the housing 1.

The cover 28 also includes a plurality of flexible arms 35 constituting integral parts of the cover itself. When the cover 28 is mounted on the housing of the device 1, each of the arms 35 exerts an axial thrust on the annular band 26*a* of the support element 26 by means of its free end 35*a*.

As is best seen in FIG. 3, as a result of the difference in thickness (E) between the spacer element 27 and the operating element 25, the axial thrust exerted by the free ends 35*a* of the arms 35 causes the resilient deformation of the support element 26 into a disposition in which the radially outer margin of each element 25 acts as a fulcrum to cause the raising of the radially inner end 25*a* of the element 25 from the face 21*a* when the electromagnets 16 are de-energized, that is the orientation of the element 25 towards its position.

The rest position of the operating members 25, that is, the position adopted by these members when the respective excitation electromagnets 16 are de-energized, is thus unequivocally determined by dimensional factors: specifically, by the value of the difference in level E relative to the overall length of the operating members.

The fact that all the operating members 25, which are identical to each other, are fixed to a single resilient support element, the deformation of which is controllable with great precision, ensures that, in the rest position, all the operating members 25 are at exactly the same angle to the end face 21*a* of the retaining mass 21, and that, consequently, all the radially inner ends 25 of the operating members 25 and the heads 13 of the corresponding wires 8 are in exactly the same axial position relative to the housing of the device.

This ensures that, when the electromagnets 16 are energized, each operating element 25 and the printing wire 8 controlled thereby describe exactly the same path of movement to achieve the ballistic action on the inked ribbon 15.

The elastic properties of the support element 26 also determine unequivocally the resilient force which retains and returns the operating members 25 towards the rest position, and consequently the force which opposes the return of the members 25 to the end part 21*a* during the percussive action on the wires 8.

The uniformity of the resilient properties of the support element 26 thus ensures that the resilient return force exerted on all the operating members 25 is exactly identical.

Thus, it is possible to achieve the maximum uniformity in the operating characteristics of all the wires 8 of the printing device, and consequently the uniformity of the ink dots transferred to the printing surface 5.

The disadvantages typical of many matrix printing devices of the known art are thus avoided. The results described above can be achieved with particular precision and with good reproducibility when, in the preferred embodiment illustrated here (FIG. 3), the ends of the flexible arms 35*a* and the face of the spacer element 27 cooperating with the support element 26 have a curved profile.

An assembled arrangement of the cover 28 found to be particularly advantageous is that in which the flexible arms 35 act on the annular band 26*a* of the support element 26 in regions (illutrated schematically in broken outline and indicated 35' in FIG. 4) located in positions angularly intermediate two adjacent appendages 26*b* of the element 26.

If this solution is adopted, the deformation of the support element 26 is achieved essentially by twisting the annular band 26*a* in the regions angularly between the appendages 26*b* and the regions 35' in which the arms 35 act. The effect of longitudinal bending of the appendages 26*b*, however, is substantially negligible.

Thus, it is possible to apply the necessary return force to the operating members 25 without exerting excessive forces on the material of the support element.

Preferably, the assembly of the cover 28 on the housing of the printing device 1 is effected by an engagement which allows the axial position of the cover 28 relative to the housing of the printing device to be adjusted by turning the fixing screw 29.

In the embodiment illustrated, this result is achieved by providing the cover 28 with appendages 36 together defining an axially-slotted tubular body which is slidably engaged in the axial cavity of the retaining mass 21, while the root portions of the appendages 36 themselves are maintained at a certain distance from the end face 21*a* defining a gap 37 relative to the retaining mass 21 the width of which can be adjusted by means of the screw 29.

By adjusting the axial position of the cover 28 one can regulate the degree of deformation to which the arms 35 are subject and consequently the pressure which these arms exert on the support element 26 to deform it. The degree of this force is normally adjusted to about 1.96 N.

It should be noted that the curved face of the spacer element 27 and the rounded ends 35*a* of the arms 35 are shaped such that the adjustment of the assembled position of the cover 28 and the consequent regulation of the force exerted by the arms 35 on the support element 27 does not result in a corresponding variation in the deformed configuration assumed by the support element 26 itself. This deformed configuration is in fact substantially determined by the dimensional relationship (difference in level E) between the spacer element 27 and the operating members 25.

It is thus possible to adjust the retaining force exerted on the operating members 25 very precisely without modifying the rest position of these members.

Naturally, the principle of the invention remaining the same, the constructional details and forms of embodiment may be varied widely with respect to that described and illustrated, without thereby departing from the scope of the present invention.

What is claimed is:

1. A matrix printing device comprising: a housing body which can effect a translational movement relative to a printing surface in use; a plurality of wires slidable in the housing body and each having one end for acting on the print surface as a result of a thrust exerted on its other end, a plurality of oscillating operating members for exerting a thrust on a respective wire, and electromagnetic excitation circuits for selectively oscillating each of said operating members from a rest position to a position of thrusting the respective wire, wherein the improvement consists in said device further including a single resilient support element to which the operating members are fixed, the position of fixing of each operating member to the support element and the resilient properties of the support element determining, respectively, the path of oscillation of the operating member and the degree of resilient force returning said member to its rest position, wherein said resilient support element includes an annular band and a plurality of appendages extending radially from the band, each of said appendages constituting a support for the fixing of a respective operating member, said matrix printing device further comprising a substantially annular retaining mass incorporating said excitation circuits and having a flat end face, the operating members constitute movable armatures of their respective excitation circuits and being distributed in a radial configuration on said flat end face of the retaining mass, and wherein:

each operating member is fixed to the resilient support element by that face of the operating member which is opposite the retaining mass;

a spacer element having a thickness slightly less than the thickness of the operating members is provided between the retaining mass and the annular band of the support element, and pressure means are associated with said housing body, which act on the annular band of the support element to thrust the support element and the spacer element against said end face of the retaining mass and cause, as a result of the difference in thickness between the spacer element and the operating members, the resilient deformation of the support element and the consequent orientation of the operating members into a rest position in which the end of each operating member opposite the support element is at a certain distance from said flat end face and is selectively returnable towards said face to achieve said thrust on the corresponding wire by the activation of the corresponding excitation circuit.

2. A device as defined in claim 1, wherein the spacer element has a radially curved end face facing the resilient support element.

3. A device as defined in claim 1, wherein the pressure means act on the support element in a position angularly intermediate the fixing appendages of two adjacent operating members, whereby the resilient deformation of the support element is achieved substantially by twisting of said annular band.

4. A device as defined in claim 1, wherein said pressure means include a plurality of flexible arms which act on the annular band of the support element.

5. A device as defined in claim 4, wherein the flexible arms have rounded ends for cooperating with the support element.

6. A device as defined in claim 4, wherein the device includes a cover member which is coupled to said housing body and carries said flexible arms.

7. A device as defined in claim 6, wherein said arms are integral with said cover member.

8. A device as defined in claim 6, wherein the coupling between the cover member and the housing body is selectively variable in order to adjust the pressure exerted by the flexible arms on the support elements.

* * * * *